US009638494B1

(12) United States Patent
Murphy et al.

(10) Patent No.: US 9,638,494 B1
(45) Date of Patent: May 2, 2017

(54) AIMING SIGHT APPARATUS FOR DEVICES THAT SHOOT PROJECTILES

(71) Applicants: Stephen P Murphy, Brewton, AL (US); Alex F Farris, III, Birmingham, AL (US)

(72) Inventors: Stephen P Murphy, Brewton, AL (US); Alex F Farris, III, Birmingham, AL (US)

( * ) Notice: Subject to any disclaimer, the term of this patent is extended or adjusted under 35 U.S.C. 154(b) by 0 days.

(21) Appl. No.: 15/267,157

(22) Filed: Sep. 16, 2016

Related U.S. Application Data

(63) Continuation of application No. 14/845,102, filed on Sep. 3, 2015, now Pat. No. 9,448,037.

(51) Int. Cl.
*F41G 1/467* (2006.01)
*F41G 1/033* (2006.01)

(52) U.S. Cl.
CPC ..... *F41G 1/467* (2013.01); *F41G 1/033* (2013.01)

(58) Field of Classification Search
CPC ..... F41G 1/033; F41G 1/08; F41G 1/457
USPC ..... 33/265; 124/87, 90
See application file for complete search history.

(56) References Cited

U.S. PATENT DOCUMENTS 3,455,027 A * 7/1969 Perkins ..... F41G 1/467 124/23.1
4,385,448 A * 5/1983 Burkey ..... F41G 1/467 33/265
4,481,717 A 11/1984 Kowalski
4,567,668 A 2/1986 King et al.
4,625,422 A * 12/1986 Carlson ..... F41G 1/467 124/87
5,137,007 A * 8/1992 Shoemake ..... F41G 1/467 124/87
5,653,217 A 8/1997 Keller
5,860,408 A * 1/1999 Summers ..... F41G 1/467 124/87
RE36,266 E 8/1999 Gibbs
6,058,921 A * 5/2000 Lawrence ..... F41G 1/467 124/87
6,170,164 B1 * 1/2001 Knowles ..... F41G 1/467 124/87
6,539,637 B1 4/2003 Hollabaugh
7,040,027 B1 * 5/2006 Shaffer ..... F41G 1/467 124/87
7,266,896 B1 9/2007 White
7,290,345 B2 11/2007 Ellig
7,503,122 B2 3/2009 Afshari
(Continued)

*Primary Examiner* — R. A. Smith
(74) *Attorney, Agent, or Firm* — Gerald M. Walsh; Leo Law Firm LLC

(57) ABSTRACT

An aiming sight for devices that shoot projectiles having a housing with an interior. A sight element is positioned within the interior by means of adjustment threads. The adjustment threads pass through channels in the sides of the front sight element so that the front sight element is movable along the adjustment threads from the bottom to the top of the housing. The sight element has a sighting aperture through which a specific target point, intended for penetration by an arrow, is visible. The sighting aperture may be constructed as a front sighting aperture of a front aiming sight to align visually with a rear sighting aperture of a rear aiming sight. When aiming, the specific target point is viewed in the voids of the front sighting aperture and the rear sighting aperture without obstruction.

16 Claims, 4 Drawing Sheets

(56) References Cited

U.S. PATENT DOCUMENTS

| | | | | |
|---|---|---|---|---|
| 7,644,503 | B2 | 1/2010 | Lewisl | |
| 7,895,996 | B2 | 3/2011 | Grove | |
| 8,453,336 | B2 * | 6/2013 | LoRocco | F41G 1/467 124/87 |
| 2014/0158106 | A1 * | 6/2014 | Deien | F41G 1/467 124/87 |

* cited by examiner

AIMING SIGHT APPARATUS FOR DEVICES THAT SHOOT PROJECTILES

CROSS-REFERENCE TO RELATED APPLICATION

This is a continuation application of prior application Ser. No. 14/845,102 filed on Sep. 3, 2015, currently pending.

FIELD OF THE INVENTION

This invention relates to aiming sights and, more particularly, to an aiming sight that has a sight element slideably mounted in a housing attached to a device that shoots projectiles, wherein the sight element has a sighting aperture that is not obscured when aiming the device at a target.

BACKGROUND OF THE INVENTION

Rifles, guns, and archery bows usually use aiming sights to improve the accuracy of aiming. In the case of archery, for example, to ensure proper targeting and trajectory of an arrow, certain sighting processes and devices have been developed over time to improve accuracy and precision of the flight of the released arrow. One such sighting device comprises a rear bow sight installed within multi-string bowstrings, and sighting pins or balls installed on the bow itself. As the archer sets the arrow, and draws the arrow and bowstring rearward in a typical fashion, the rear bow sight and sighting pins are aligned to ensure accuracy of the released arrow to the target at a determined distance downrange. FIG. 1 illustrates this method of aiming the arrow. A rear sight 1 has an outer circumferential surface 2 and an inner circumferential surface 3. The inner circumferential surface 3 defines an aperture 4 through which a front sight 5 can be viewed. The rear sight 1 has string notches 6 for attaching the rear sight 1 within the strands of a bow string. FIG. 1 shows the front sight 5 having a sight pin 7 and point or ball 8 at the tip of the sight pin 7. The rear sight 1 is shown visually aligned with the front sight 5. In aiming, the point or ball 8 is visually positioned over an intended specific location on a target and is simultaneously visually positioned within the aperture 4 of the rear sight 1 so that the specific location on the target will be penetrated by the arrow after the arrow has been released from the bow string. Since the ball 8 is visually positioned over the intended specific location on the target, the archer can no longer see the specific location. If the target moves it is difficult, if not impossible, for the archer to keep the ball 8 visually positioned over the intended specific location on the target. What is needed is a front sight and rear sight system that will allow an archer to view the intended specific location on the target without any visual obstruction of the intended specific location.

SUMMARY OF THE INVENTION

This invention provides an aiming sight for devices that shoot projectiles. The aiming sight has a housing with an interior defined by interior walls. A sight element is positioned within the interior by means of adjustment threads. The adjustment threads are attached to the interior walls of the housing. The sight element has a sighting aperture through which a specific target point, intended for penetration by a projectile, is visible. Preferably, the sighting aperture is triangular shaped. The sight element has channels on each side, wherein the adjustment threads pass through the channels so that the sight element is movable along the adjustment threads from one side (bottom) of the housing to an opposite side (top) of the housing. The sighting aperture can be constructed as a first sighting aperture of a first aiming sight to align visually with a second sighting aperture of a second aiming sight, wherein the specific target point is visible through both the first sighting aperture and the second sighting aperture when the first sighting aperture and the second sighting aperture are visually aligned.

The aiming sight of this invention is remarkably effective in improving the aiming and accuracy of an archery bow compared to other aiming sights. The aiming sight can be used as a front sight on the bow. A second aiming sight can be used as a rear sight which may be positioned anywhere between the eye of a user and the front sight, such as, for example, in the strings of the bow. The sighting aperture in the front sight is visually aligned with the sighting aperture of the rear sight. The specific target point is viewed through both the sighting aperture of the front sight and the sighting aperture of the rear sight without any obstruction of the view of the specific target point.

An advantage of this invention is an increased accuracy of aiming at a specific target point, compared to other aiming sights.

Another advantage is an aiming sight with a sight element suspended in the interior of the aiming sight, wherein the sight element is adjustable upward and downward to adjust for distance.

Another advantage is an aiming sight wherein a specific target point is not obscured in the sighting aperture when the specific target point is viewed through the sighting aperture.

Another advantage is a front sight constructed to align with a rear sight to produce highly accurate aiming because the specific target point is not obscured in the voids of the front and rear sighting apertures.

Another advantage is an aiming sight that has a triangular shaped sighting aperture to facilitate the process of aiming.

DETAILED DESCRIPTION OF THE INVENTION

While the following description details the preferred embodiments of the present invention, it is to be understood that the invention is not limited in its application to the details of construction and arrangement of the parts illustrated in the accompanying figures, since the invention is capable of other embodiments and of being practiced in various ways.

Figure 1:
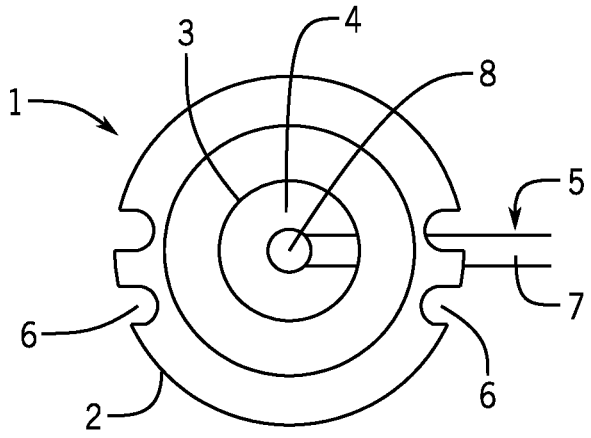
FIG. 1 PRIOR ART
FIG. 1 shows a front elevation view of a prior art front sight pin visually aligned with a rear sight.
Figure 2:
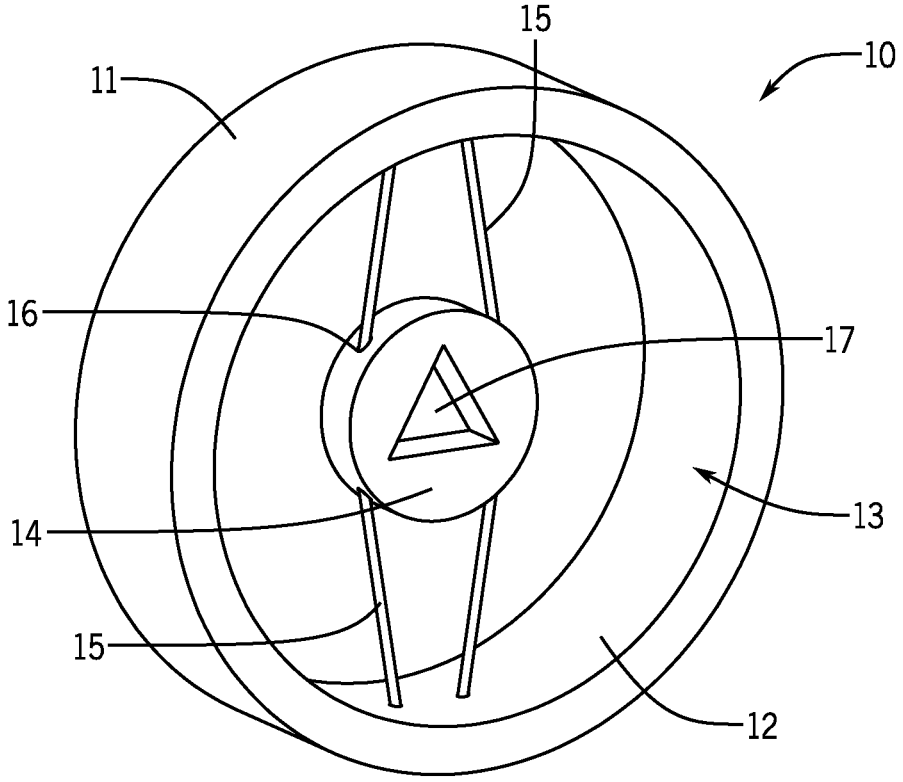
FIG. 2 shows a front, left, perspective view of the aiming sight of the present invention.

FIG. 2 shows the aiming sight 10 of the present invention. The aiming sight 10 has a housing 11 with a circular shape. The housing 11 has internal walls 12 which define an interior 13. A sight element 14 is mounted within the interior 13 by means of mounting threads or strings 15. The sight element 14 has 2 channels 16, one on each side of the sight element 14, through which the mounting threads 15 pass. The ends of the mounting threads 15 are attached to the internal walls 12 so that the sight element 14 is suspended within the interior 13 and is movable and slidable along the mounting threads 15 from one side of the housing 11 to an opposite side of the housing 11. The sight element 14 has a sighting aperture 17 through which the specific intended point on a target can be seen by an archer. The sighting aperture 17 can have any desired shape, preferably, a triangular shape.

Figure 3A:
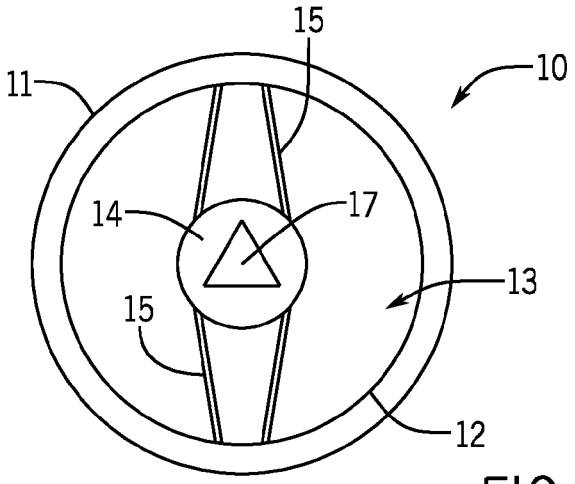
FIGS. 3*a*-3*c* show front elevation views of the sight element of the aiming sight, adjusted in various positions.
Figure 3B:
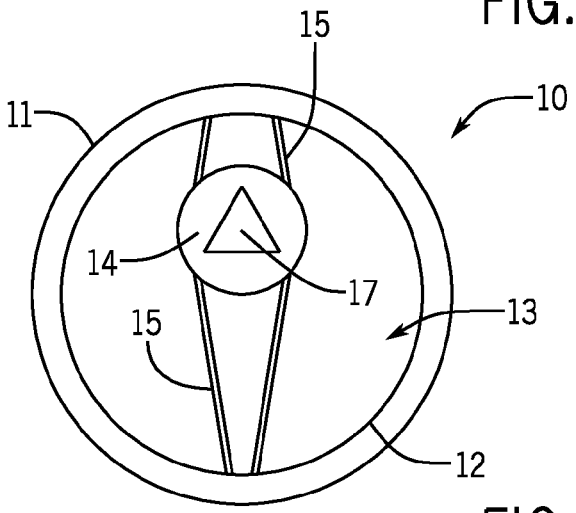
Figure 3C:
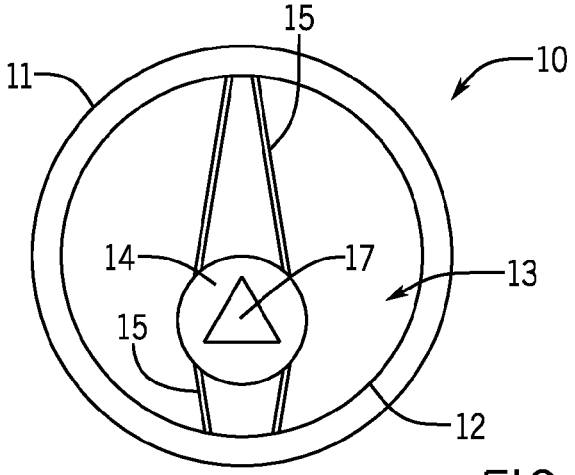

FIG. 3*a* shows the aiming sight 10 with the mounting threads 15 oriented vertically. The sight element 14 is suspended in the center of the interior 13. FIG. 3*b* shows the sight element 14 moved upward along the mounting threads 15 towards one side (top) of the housing 11. FIG. 3*c* shows the sight element 14 moved downward along the mounting threads 15 towards an opposite side (bottom) of the housing 11. Thus, an archer can raise and lower the sight element 14 to adjust for distance to the target.

Figure 4:
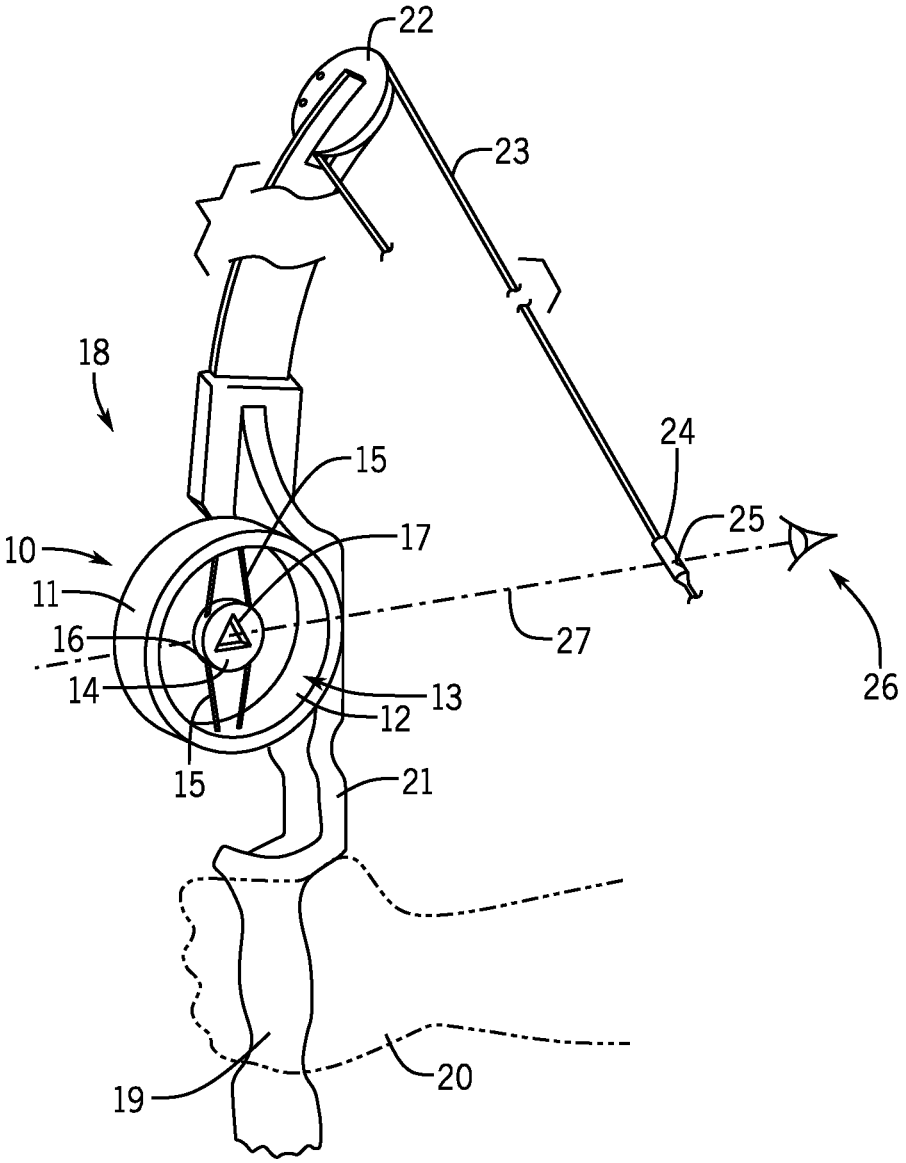
FIG. 4 shows a front, left, perspective view of the sight element positioned on a bow.

FIG. 4 illustrates the use of the aiming sight 10 with a rear aiming sight 24 in archery bow 18. The bow 18 has a hand gripping portion 19 shown being held by the hand 20 of an archer. The bow 18 has a front sight mounting portion 21. The aiming sight 10 of the present invention is shown attached to the mounting portion 21, with the mounting threads 15 parallel to the mounting portion 21. The aiming sight 10 in this configuration functions as a front sight. FIG. 4 shows the bow 18 having pulleys 22 and a bowstring 23. The rear sight 24 is mounted in the bow string 23 and has a sighting aperture 25 for visual alignment with the sighting aperture 17 of the aiming sight 10. FIG. 4 further illustrates the eye 26 of an archer visually aligning the sighting aperture 25 of the rear sight 24 with the sighting aperture 17 of the aiming sight 10, creating a sight line 27 to the target.

Figure 5:
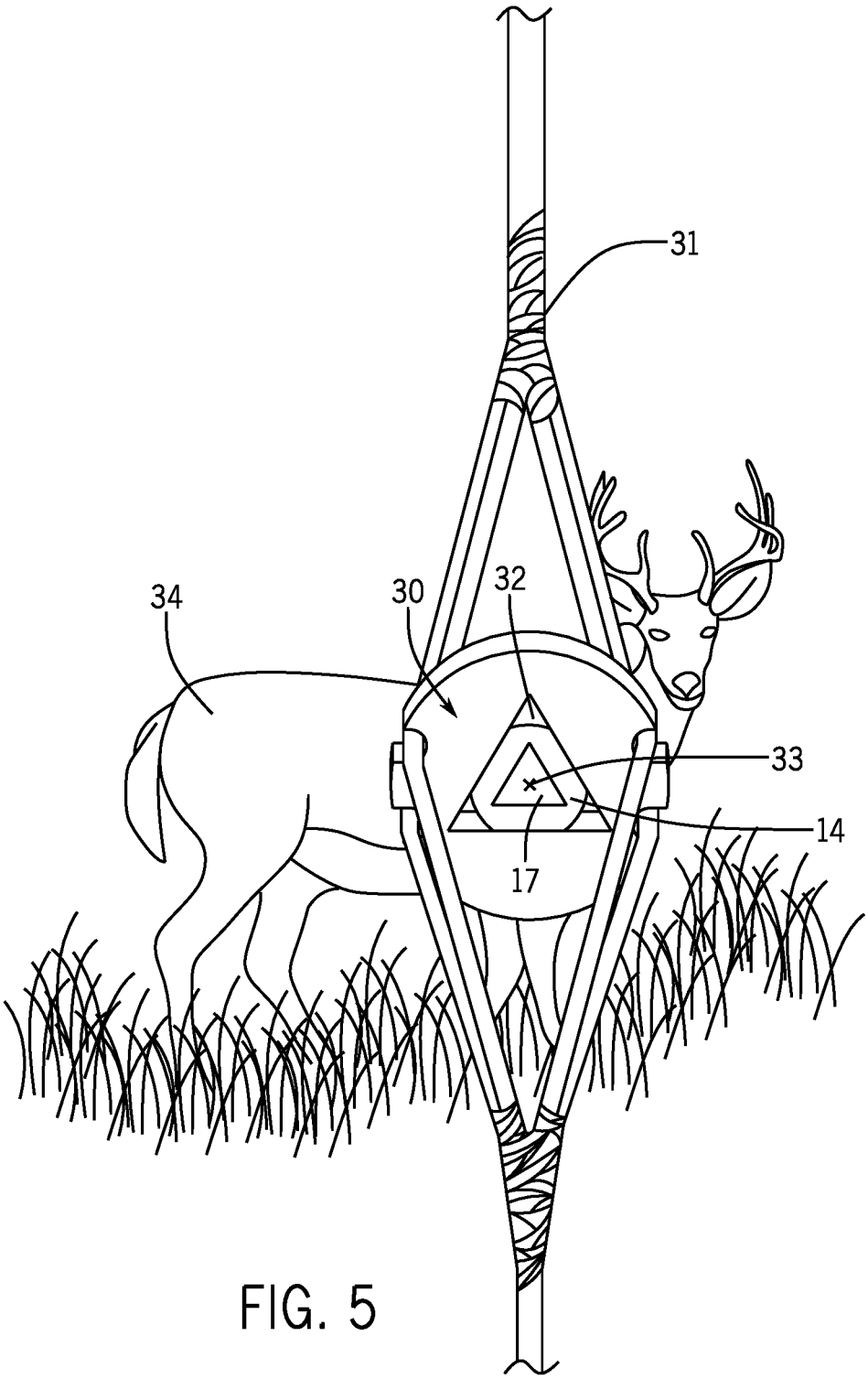
FIG. 5 shows a front, top, perspective view of a rear bow sight visually aligned with the aiming sight.

FIG. 5 illustrates a sighting aperture 32 of a rear sight 30 visually aligned with the sighting aperture 17 of the front sight element 14 of the aiming sight 10 which is in front of rear sight 30. The rear sight 30 is positioned in the bow string 31 of a bow. The rear sighting aperture 32 and the front sighting aperture 17 are visually aligned with a specific point 33 on a deer target 34. With this arrangement the specific point 33, intended to be penetrated by an arrow, is clearly visible to the archer and provides improved accuracy compared to aiming with the ball of a sight pin in alignment with a rear sight. This is so because the ball of the sight pin obscures the archer's view of the specific point intended to be penetrated by the arrow. If the target moves, it is relatively easy for the archer to keep the specific point 33 visually aligned with the rear sighting aperture 32 and the front sighting aperture 17. This results in much improved accuracy of striking a specific point on a target, compared to other methods of aiming with a bow.

A triangular shaped front sighting aperture 17 and rear sighting aperture 32 significantly increases the accuracy of aiming. With a triangle shape the brain does not have to think about a sight picture as it does with a rectangle or a circle. When one point of the triangle shape of the front sighting aperture 17 is seen through the triangle shape of the rear sighting aperture 32, a user can visually align one point of the front triangle shape with one point of the rear triangle shape, allowing the front triangle shape and the rear triangle shape to become properly aligned automatically. In addition, it is easy to maintain the visual alignment of the front and rear triangle shapes as the bow is moved to the left or right to follow the point on the target, which is essential for hitting a moving target.

This invention provides a method of aiming an arrow at a specific target point 33 intended for penetration by the arrow. The aiming bow sight 10 of this invention is provided on an archery bow as a front sight. The sighting aperture 17 is aligned visually with a rear sighting aperture 32. The specific target point 33 is then viewed through the sighting aperture 17 and the rear sighting aperture 32 when the sighting aperture 17 and the rear sighting aperture 32 are visually aligned. The specific target point 33 is, thus, viewed through the voids of the sighting aperture 17 and the rear sighting aperture 32 without any obstruction.

The foregoing description has been limited to specific embodiments of this invention. It will be apparent, however, that variations and modifications may be made, by those skilled in the art, to the disclosed embodiments of the invention, with the attainment of some or all of its advantages and without departing from the spirit and scope of the present invention. For example, a triangular shaped sighting aperture can have any desired orientation. The sighting aperture can also be round or rectangular instead of triangular. The mounting threads can be made of any suitable material, such as plastic, metal, or textile. The rear sight can be positioned anywhere behind the front sight besides being positioned in the bow strings. The aiming sight can be movably mounted on the bow as a front sight so that the front sight is rotatable and can be moved and adjusted horizontally.

It will be understood that various changes in the details, materials, and arrangements of the parts, which have been described and illustrated above in order to explain the nature of this invention, may be made by those skilled in the art without departing from the principle and scope of the invention as recited in the following claims.

We claim:

1. A front aiming sight for devices that shoot projectiles, comprising:

a) a housing having an interior defined by interior walls;

b) a sight element positioned within said interior with an open space between said interior walls and said sight element; and c) said sight element having a sighting aperture through which a specific target point on a target is visible without obstruction within said sighting aperture and said target is also visible in said open space between said interior walls and said sight element.

2. The aiming sight of claim 1 wherein said sight element is movable from one side of said interior walls to an opposite side of said interior walls within said open space.

3. The aiming sight of claim 2 wherein said device that shoots projectiles is an archery bow.

4. The aiming sight of claim 1 wherein said sighting aperture is triangular shaped.

5. The aiming sight of claim 4 wherein said device that shoots projectiles is an archery bow.

6. The aiming sight of claim 1 wherein said device that shoots projectiles is an archery bow.

7. A method of aiming a device that shoots projectiles, comprising:

1) providing said first front aiming sight according to claim 1; and 2) viewing a target through said open space between the interior walls and said sight element and viewing a specific target point on said target through said sighting aperture in said sight element.

8. The method of claim 7 wherein said sight element is movable from one side of said interior walls to an opposite side of said interior walls within said open space.

9. The method of claim 8 wherein said device that shoots projectiles is an archery bow.

10. The method of claim 7 wherein said sighting aperture is triangular shaped.

11. The method of claim 10 wherein said device that shoots projectiles is an archery bow.

12. The method of claim 7 wherein said device that shoots projectiles is an archery bow.

13. A front aiming sight for devices that shoot projectiles, comprising:

a) a housing having an interior defined by interior walls;

b) a sight element positioned within said interior with an open space between said interior walls and said sight element; and c) said sight element having a sighting aperture through which a specific target point on a target is visible without obstruction within said sighting aperture and said target is also visible in said open space between said interior walls and said sight element, wherein said sight element is movable from one side of said interior walls to an opposite side of said interior walls within said open space and wherein said sighting aperture is triangular shaped.

14. The aiming sight of claim 13 wherein said device that shoots projectiles is an archery bow.

15. A method of aiming a device that shoots projectiles, comprising:

1) providing said first front aiming sight according to claim 4; and 2) viewing a target through said open space between the interior walls and said sight element and viewing a specific target point on said target through said sighting aperture in said sight element.

16. The method of claim 15 wherein said device that shoots projectiles is an archery bow.

* * * * *